US006386861B1

(12) United States Patent
Sher

(10) Patent No.: US 6,386,861 B1
(45) Date of Patent: May 14, 2002

(54) LIGHTER WITH SAFETY SWITCH

(75) Inventor: Tak Chi Sher, Quarry Bay (HK)

(73) Assignee: Polycity Enterprise Limited (HK)

( * ) Notice: Subject to any disclaimer, the term of this patent is extended or adjusted under 35 U.S.C. 154(b) by 0 days.

(21) Appl. No.: 09/640,678

(22) Filed: Aug. 18, 2000

(51) Int. Cl.[7] ..... F23D 11/36
(52) U.S. Cl. ..... 431/153; 431/255; 431/344
(58) Field of Search ..... 431/255, 153, 431/344; 126/401, 407, 414, 25 B

(56) References Cited

U.S. PATENT DOCUMENTS 4,859,172 A * 8/1989 Nitta ..... 431/255
5,090,893 A * 2/1992 Floriot ..... 431/153
5,655,901 A * 8/1997 Makoto ..... 431/255
5,667,377 A * 9/1997 Lin ..... 431/255
6,086,359 A * 7/2000 Sher ..... 431/255

* cited by examiner

*Primary Examiner*—James C. Yeung
(74) *Attorney, Agent, or Firm*—Jackson Walker L.L.P.; Richard R. Ruble

(57) ABSTRACT

A safety lighter having a safety switch which prevents ignition of the lighter by automatically blocking the activation trigger from returning to a pre-ignition position and in turn prevents the piezoelectric actuator from returning to a pre-ignition position after the activation trigger has been urged to an ignition position.

The safety switch has a slanted member having an engagement surface and a sliding surface, and a U-shaped sliding slot member having a resilient pane, a guide arm, a blocking surface, and a safety trigger. The safety switch allows ignition of the lighter only after the safety trigger is urged upward such that the activation trigger and the piezoelectric actuator return to their pre-ignition positions.

14 Claims, 10 Drawing Sheets

Prior Art

Prior Art

LIGHTER WITH SAFETY SWITCH

BACKGROUND OF THE INVENTION

The present invention relates to a lighter device and more particularly to a unique safety system incorporated into a lighter. Specifically, the present invention relates to a safety switch which prevents the piezoelectric actuator of the lighter from returning to a pre-ignition position after urgement of the activation trigger to an ignition position.

Current safety switches found in lighters are awkward to engage. Some switches are such that when the switch is moved to the safety off position to allow the operator to ignite the lighter, by pulling a trigger mechanism, the safety remains in the safety off position allowing for subsequent unprotected ignition attempts. This may be a dangerous condition if the lighter falls into the hands of a child. Since such safety switches do not automatically re-engage to the safety on position, a child could pull the ignition trigger and ignite the lighter. Other prior art devices include U.S. Pat. Nos. 5,865,614; 5,697,775; and 5,469,169.

U.S. Pat. No. 5,697,775 illustrates and teaches a safety switch which requires the operator to press a safety switch downwardly while pulling the trigger rearwardly. While the device is difficult for children to use, it is an awkward operation for even adults to use. Further one embodiment of the device of U.S. Pat. No. 5,697,775 houses the safety switch in the trigger section of the lighter housing.

The present invention provides a safety switch that protects children from accidental ignition while also allowing convenient adult usage. The present invention provides a safety switch that effectively blocks the activation trigger from returning to a pre-ignition position. This blockage of the activation trigger prevents the piezoelectric actuator, which abuts the activation trigger, from reaching a pre-ignition position. As the actuator is responsible for creating the electric charge responsible for igniting the lighter, the safety switch effectively disables the lighter by not allowing the activation trigger to return to an pre-ignition position. The safety switch automatically disables the lighter immediately after the activation trigger is brought to an ignition position.

Once the activation trigger is placed in an ignition position, subsequent ignition is only possible after a safety trigger is urged upwardly. Upward movement of the safety trigger allows the activation trigger to return to a pre-ignition position and thus the piezoelectric actuator is allowed to return to a pre-ignition position. The lighter may then be ignited by downward movement of the activation trigger.

SUMMARY OF THE INVENTION

The present invention is a safety lighter having a safety switch which prevents subsequent ignition of the lighter once the activation trigger has been urged to an ignition position. The safety switch of the present invention blocks the activation trigger from returning to a pre-ignition position. This blockage of the activation trigger prevents the piezoelectric actuator, whose top housing abuts the activation trigger, from reaching a pre-ignition position.

The safety switch has a slanted member having a straight surface and an engagement surface, and a U-shaped sliding slot member having a resilient pane, a guide arm, a blocking shoulder, and a safety trigger. After ignition of the lighter, the safety trigger automatically resets into a safety on position. At the safety on position, the resilient pane is in a safety position along the engagement surface of the slanted member, and the guide arm is in a safety position between the straight surface of the slanted member and the straight inner surface of the lighter housing.

The blocking surface of the sliding slot member abuts the leading edge of the activation trigger and prevents the return of the activation trigger to a pre-ignition position. This blockage prevents the piezoelectric actuator from returning to a pre-ignition position, thus effectively disabling the lighter by preventing the actuator from producing an electric charge. Ignition of the lighter is allowed only upon upward movement of the safety trigger to a safety off position prior to downward movement of the activation trigger.

DETAILED DESCRIPTION OF THE PREFERRED EMBODIMENT

Figure 1:
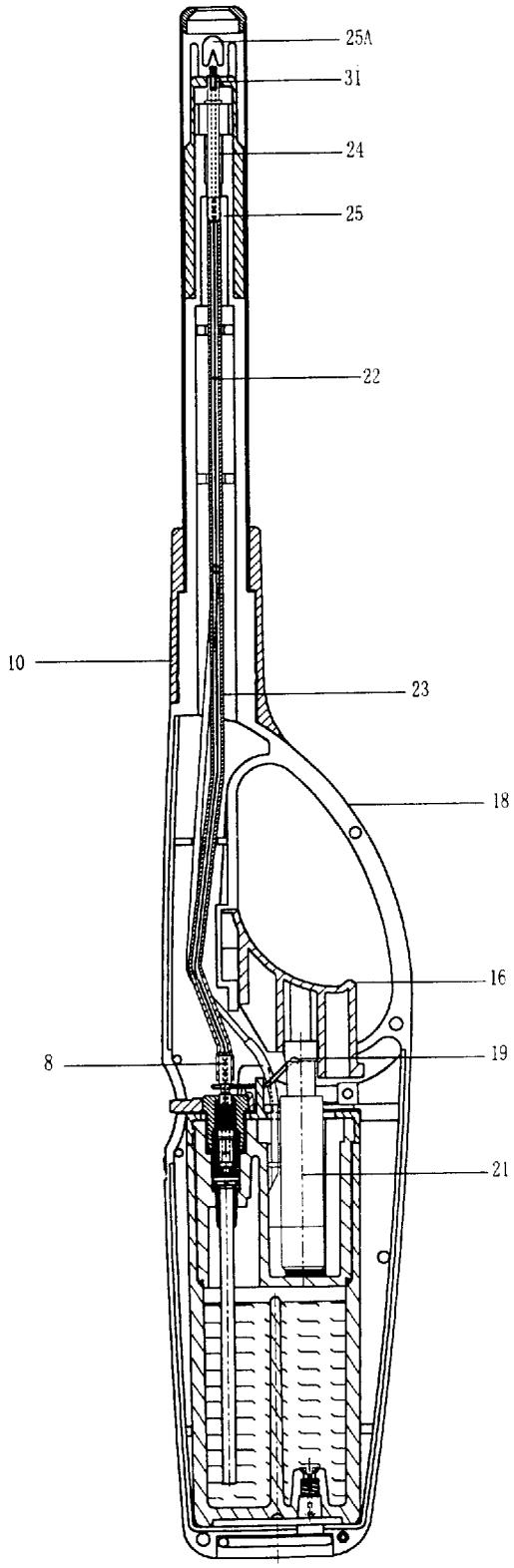
FIG. 1 is a cross sectional elevation view of a prior art lighter.

FIG. 1 illustrates a typical prior art lighter (10) having an activation trigger (16) operable within the lighter housing (18). The operation of such lighters is well known in the art. The operator holds the lighter (10) by one hand and pulls or presses the activation trigger (16) with his or her finger.

Movement of the activation trigger (16) pushes the gas lever (19) downwardly which in turn elevates nozzle A (8) to release gas. Gas is driven to upper end nozzle B (24) through gas pipe (23). At the time that the activation trigger (16) is depressed, piezoelectric actuator (21) is vibrated to emit an electric charge which is then transmitted to conductive pipe (25) through its conducting wire.

Referring to FIG. 1, because pipe (25) is a conductor, an electric charge is conducted to pipe end (25A) upon downward movement of the activation trigger (16). Simultaneously, another electric circuit transmits the electric charge to nozzle B (24) through the contact of the bottom of piezoelectric actuator (21BH) and ground wire (22). Because nozzle B (24) is a conductor, electric charge is conducted to a sparking spring (31). When meeting a spark, the gas lights a flame (100). Without the safety switch (50) of the present invention, downward movement of the activation trigger will cause ignition of the flame and result in a dangerous condition should the lighter reach the hands of a child.

Figure 2:
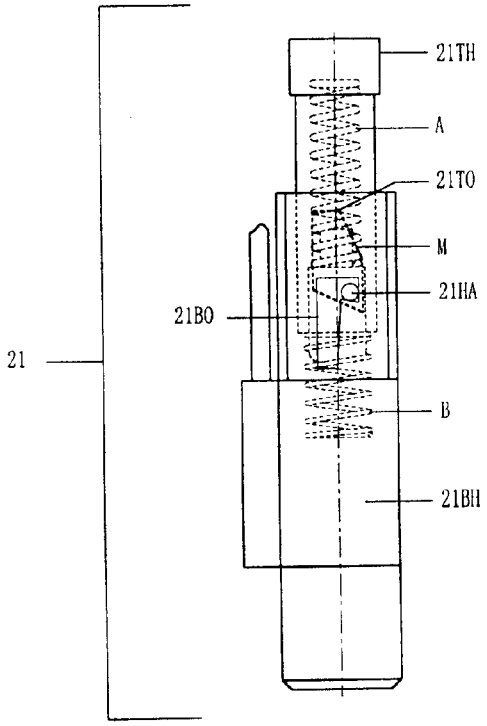
FIG. 2 is a side elevation view of a prior art piezoelectric actuator.
Figure 2A:
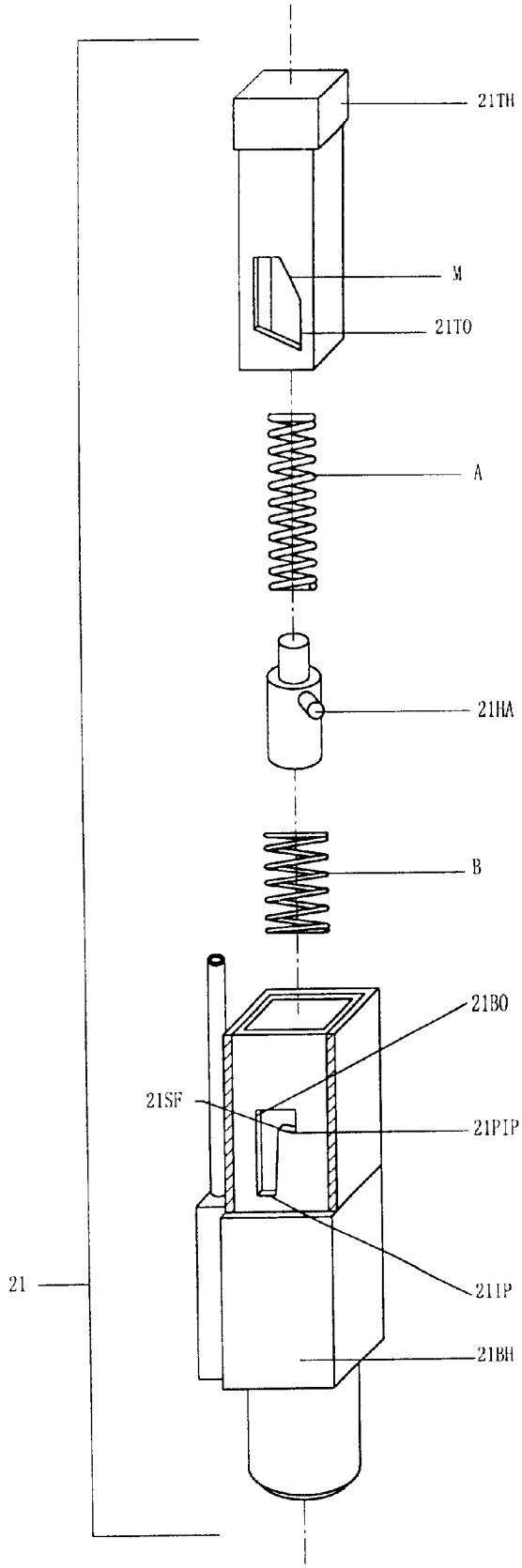
FIG. 2A is an exploded view of a prior art piezoelectric actuator.

FIGS. 2 and 2A illustrate a piezoelectric actuator (21) seen in the prior art having a top housing (21TH) and a bottom housing (21BH), both housings having an opening (21TO and 21BO, respectively) for piezoelectric hammer arm (21HA). The activation trigger (16), shown in FIG. 1, abuts the top housing (21TH) of the piezoelectric actuator such that the activation trigger (16) and the top housing of the actuator (21) move in concert. The operator effects downward movement upon the top housing (21TH) of the piezoelectric actuator (21) by initiating downward movement of the activation trigger (16).

Referring to FIGS. 2 and 2A, downward movement of the top housing (21TH) causes compression of spring (A) which in turn causes the hammer arm (21HA) to move from the piezoelectric actuator pre-ignition position (21PIP), past the actuator safety position (21SF), and downward to the ignition position (21IP). The movement of the hammer arm (21HA) between the pre-ignition position (21PIP) and the safety position (21SF) is directed by a slanting side (M) located within the top opening (21TO) of the top housing (21TH).

Compression spring (A) undergoes additional compression as hammer arm (21HA) slides along slanted side (M) between the pre-ignition position (21PIP) and the safety position (21SF), as shown in FIG. 2A. This compression combined with the compression caused by the initial downward movement of the top housing forcefully propels the hammer arm downward toward the actuator ignition position (21IP) after the hammer arm (21HA) passes the safety position (21SF). This combined compression causes the hammer arm (21HA) to strike the ignition position (21IP) with a sufficient velocity to cause the vibration required for the actuator (21) to generate an electric charge. This velocity is reached only when the hammer arm (21HA) is allowed to travel from the actuator (21) pre-ignition position (21PIP), past the safety position (21SF), and downward to the ignition position (21IP) in one movement. Movement of the hammer arm (21HA) between only the safety position (21SF) and the ignition position (21IP) will not have the velocity required to cause the required vibration in the actuator (21).

Referring further to FIGS. 2 and 2A, when the hammer arm (21HA) strikes the ignition position (21IP), compression spring (B) located between the hammer arm (21HA) and the bottom housing (21BH) of the actuator (21) provides rebound force sufficient to propel the hammer arm (21HA) upward past the safety position (21SF) back to the pre-ignition position (21PIP). The safety switch (50) of the present invention forces the hammer arm (21HA) to stop at the safety position (21SF). Only upon upward movement of the safety trigger (56) described below will the hammer arm (21HA) return to a pre-ignition position (21PIP).

Figure 3:
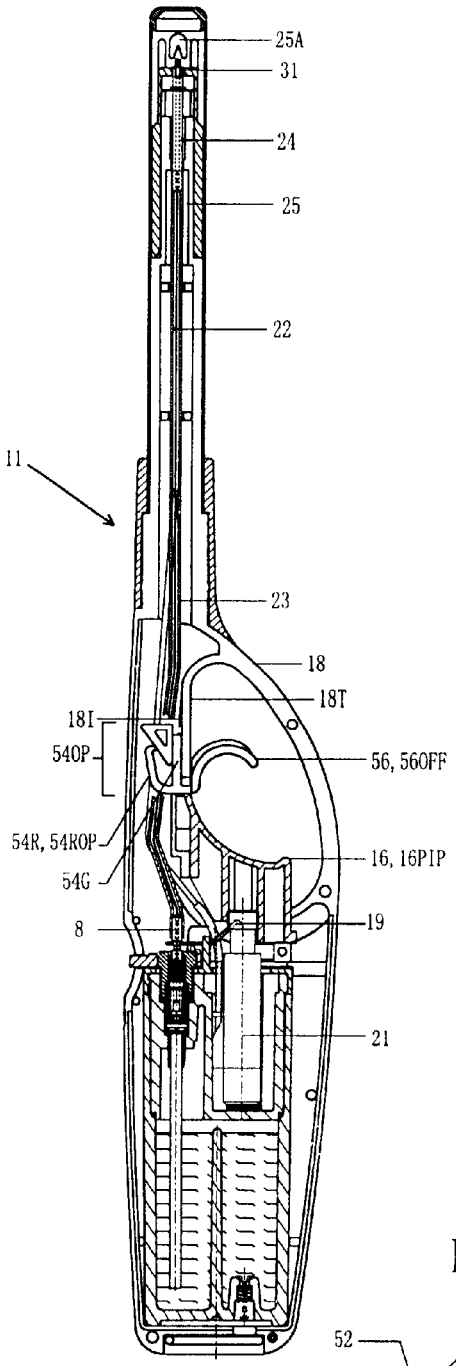
FIG. 3 is a cross sectional view of the safety lighter of the present invention illustrating the activation trigger in a pre-ignition position and the safety trigger in a safety off position.
Figure 3A:
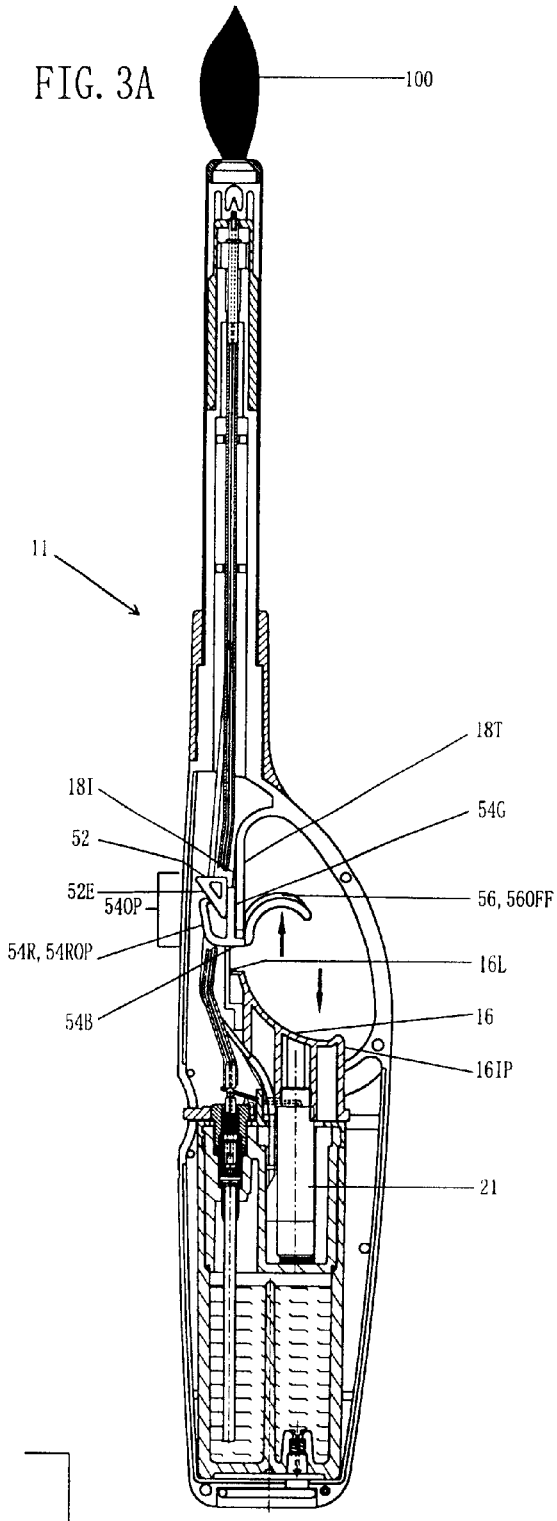
FIG. 3A is a cross sectional view of the safety lighter of the present invention illustrating the activation trigger in an ignition position and the safety trigger in a safety off position.
Figure 3B:
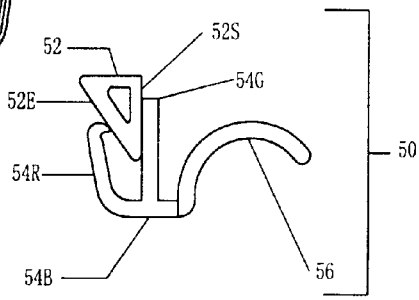
FIG. 3B is an elevation view of the components of the safety switch of the present invention.
Figure 4:
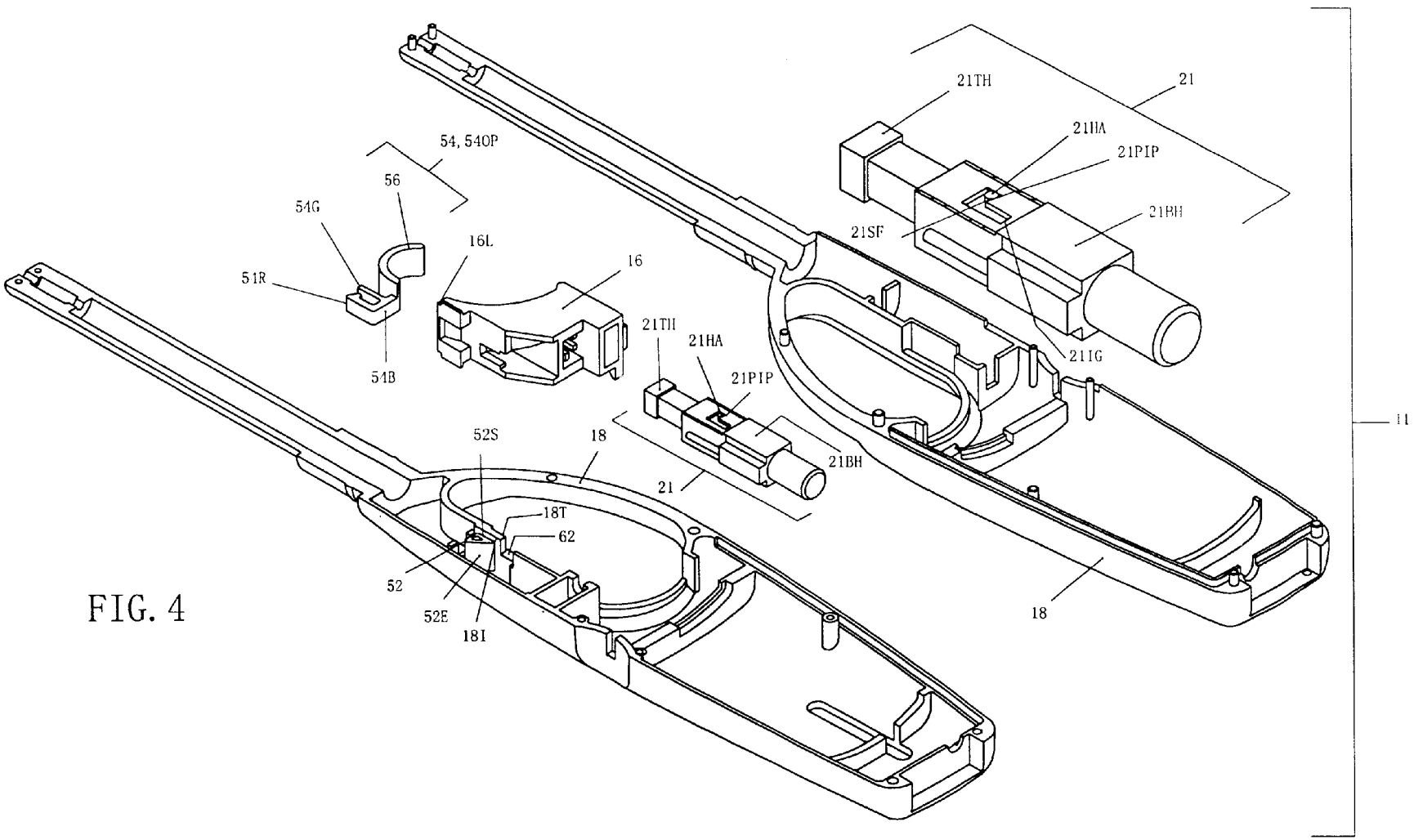
FIG. 4 is an exploded perspective view of the components of the safety lighter of the present invention illustrating the piezoelectric actuator in the pre-ignition position.
Figure 4A:
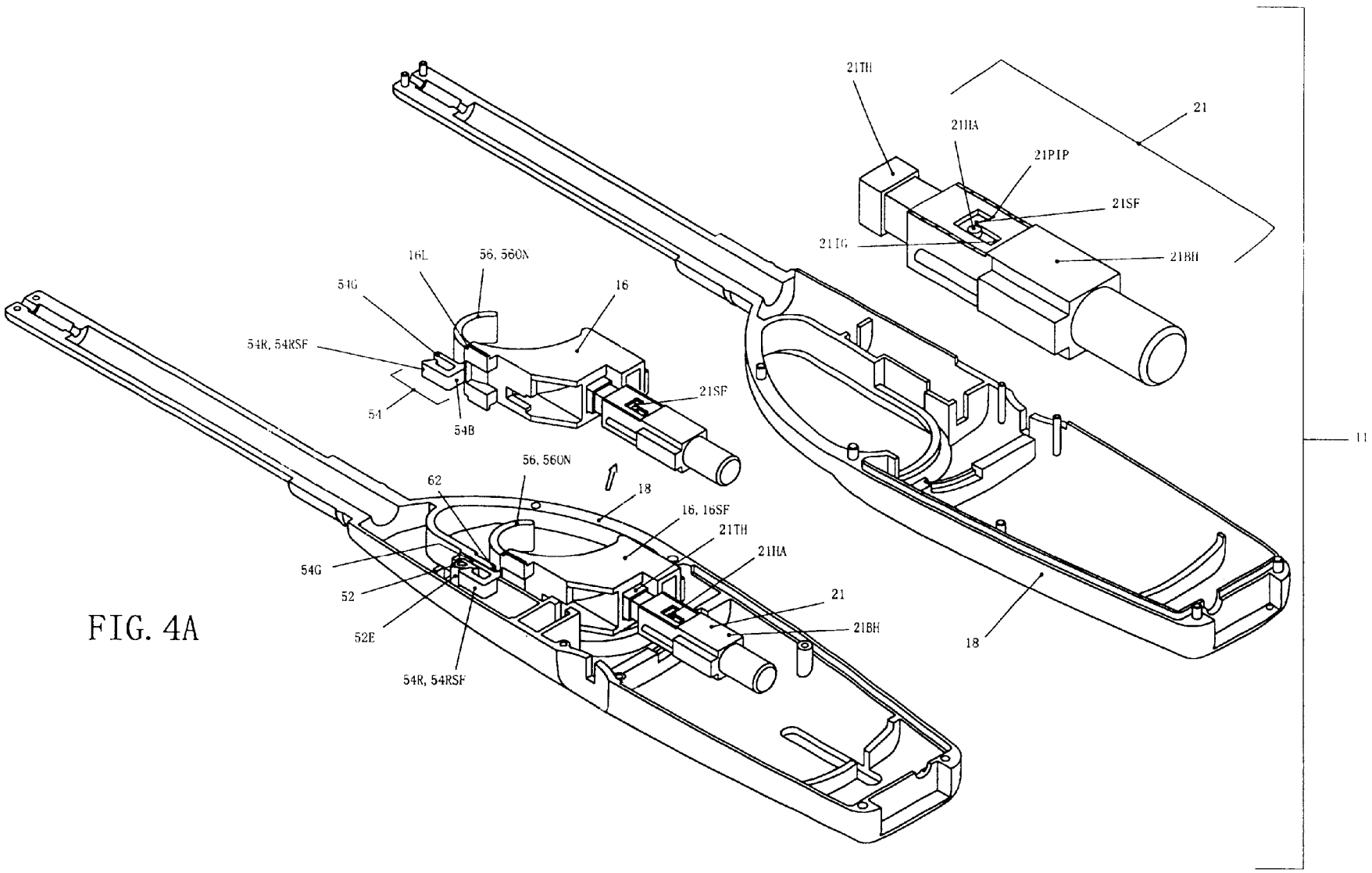
FIG. 4A is an exploded perspective view of the components of the safety lighter of the present invention illustrating the piezoelectric actuator in a safety position, the activation trigger in a stopped safety position and the safety trigger in a safety on position.
Figure 4B:
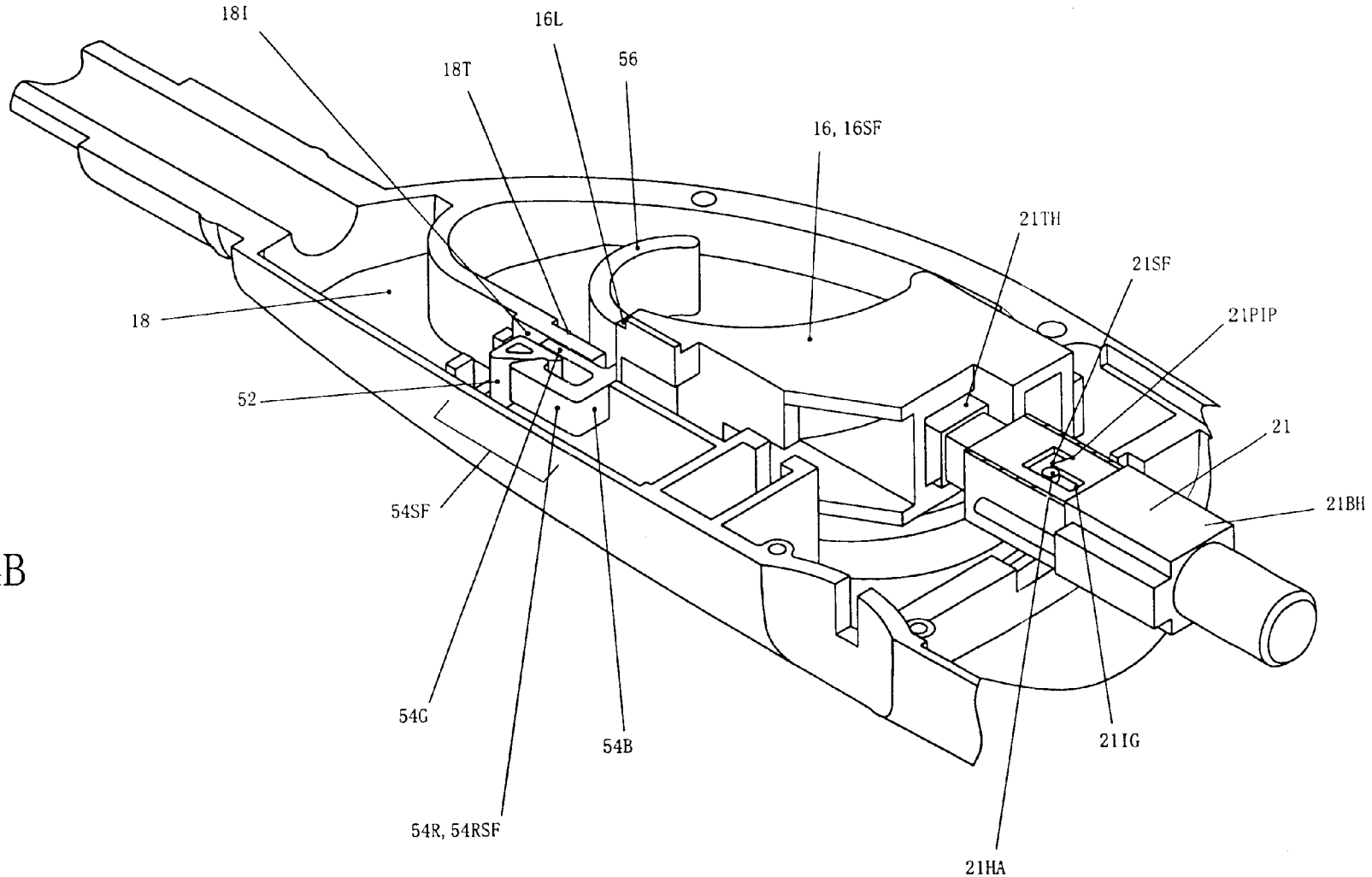
FIG. 4B is a detailed perspective partially enlarged view of the safety switch of the present invention of FIG. 4A.
Figure 5:
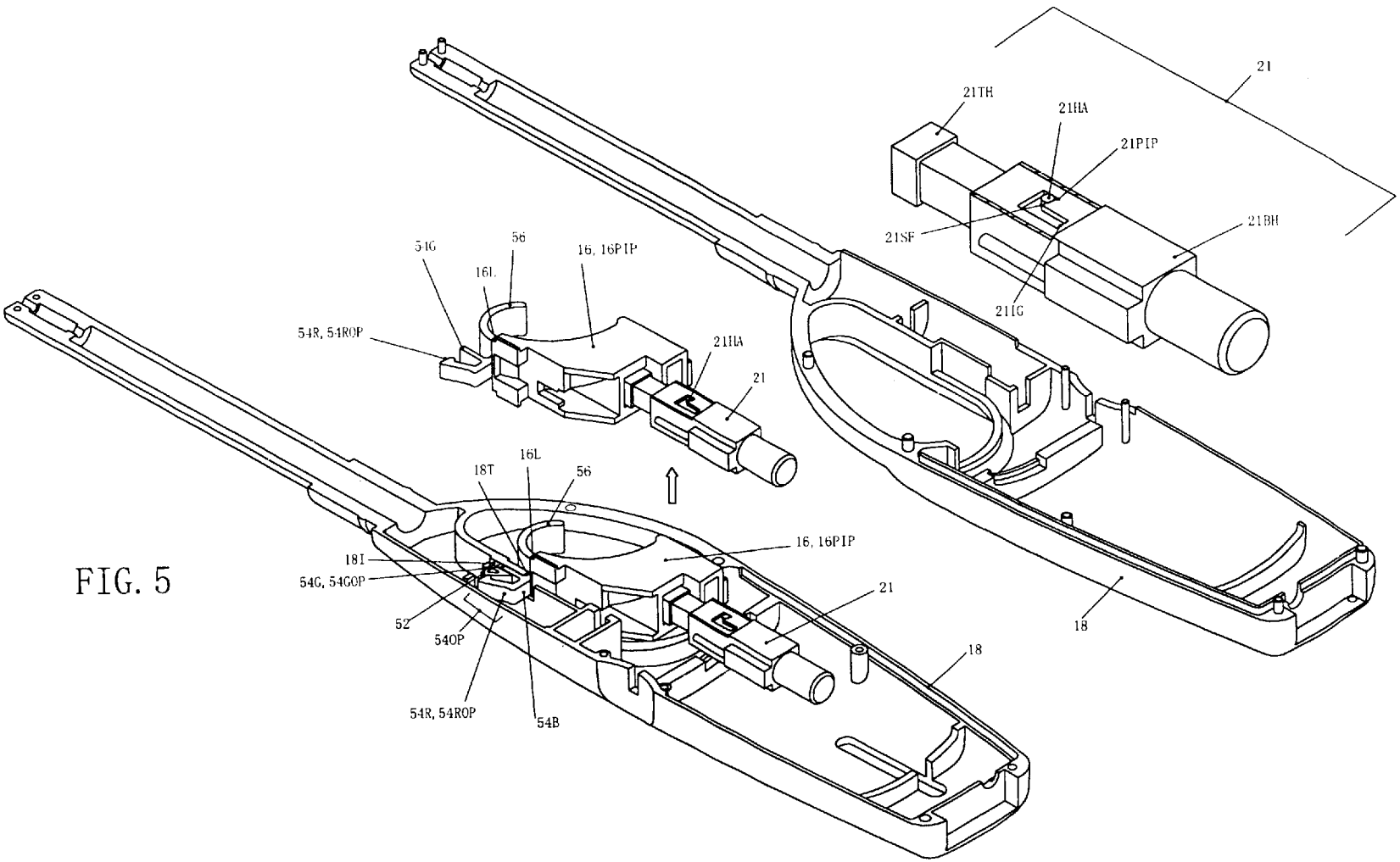
FIG. 5 is an exploded perspective view of the components of the safety switch of the present invention illustrating the activation trigger in a pre-ignition position, the piezoelectric actuator in a pre-ignition position and the safety trigger in a safety off position.
Figure 5A:
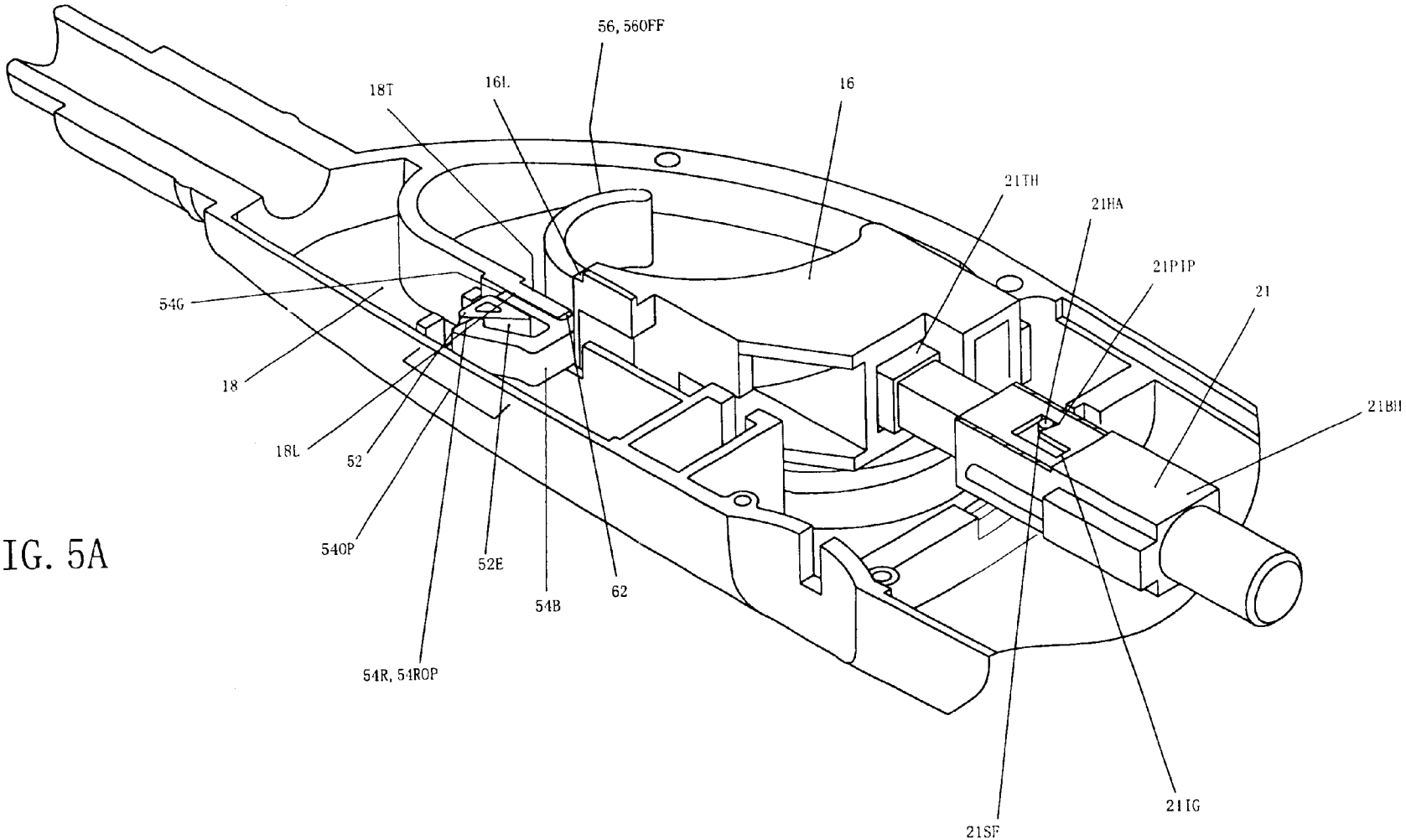
FIG. 5A is a detailed perspective partially enlarged view of the safety switch of the present invention of FIG. 5.
Figure 6:
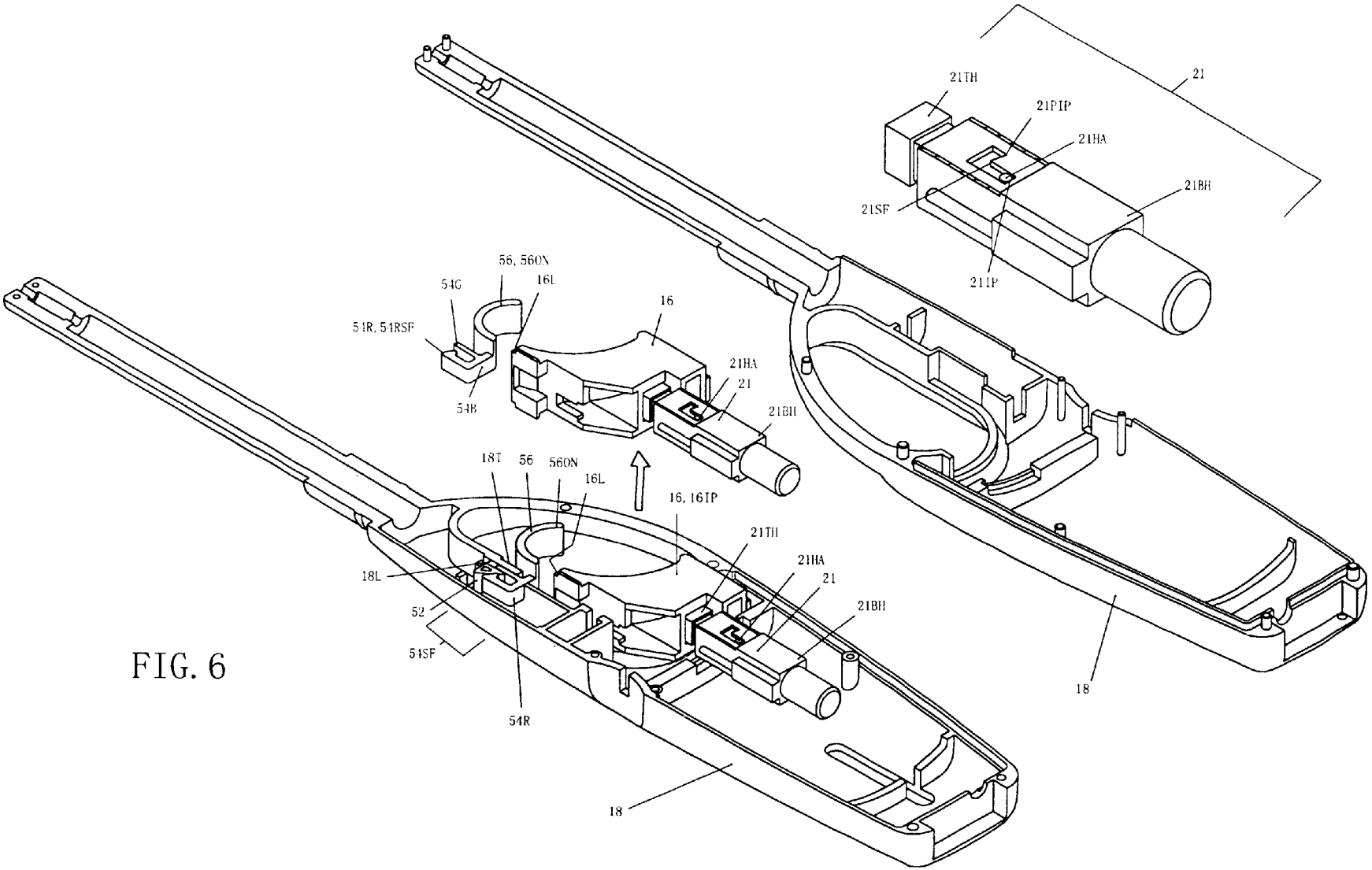
FIG. 6 is an exploded perspective view of the components of the safety switch of the present invention when the safety lighter is ignited illustrating the activation trigger in the ignition position, the piezoelectric actuator in an ignition position, and the safety trigger in a safety off position.
Figure 6A:
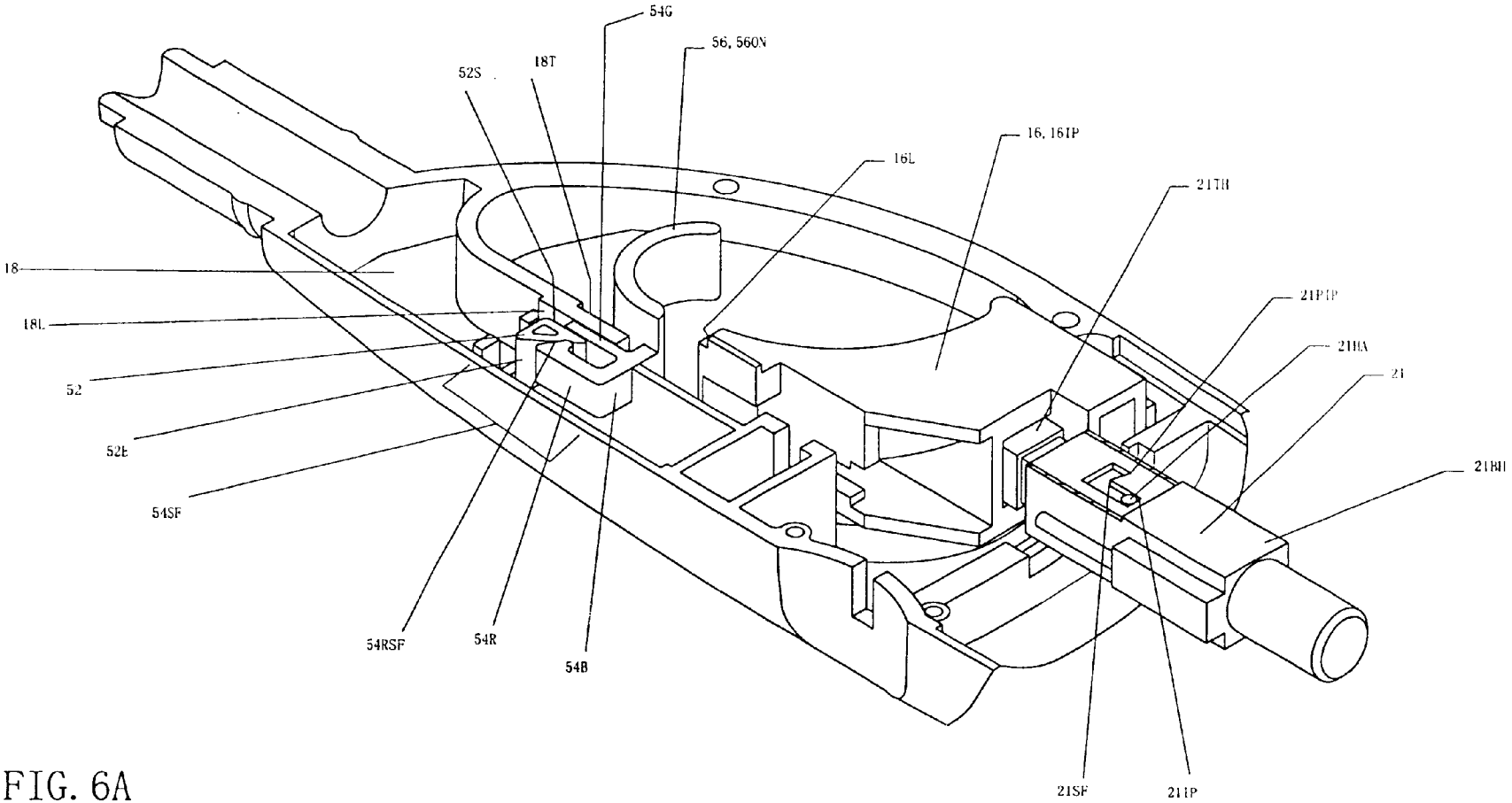
FIG. 6A is a detailed perspective partially enlarged view of the components of the safety switch of the present invention of FIG. 6.

The present invention is shown in detail in FIGS. 3, 3A, 3B, 4, 4A, 4B, 5, 5A, 6, and 6A. Referring to FIGS. 3 and 3A, the safety lighter (11) of the present invention has a housing (18), a piezoelectric actuator (21), and an activation trigger (16). The safety switch (50), best illustrated in FIG. 3B, is built into the lighter (11) without any significant modifications to the existing prior art lighter (10).

Referring to FIGS. 4, 4A, 4B, 5, 5A, 6, and 6A, the safety switch of the present invention prevents the piezoelectric actuator (21) from returning to a pre-ignition position (21PIP) after urgement of the activation trigger to an ignition position (16IP). This is done by blocking the activation trigger (16) from returning to a pre-ignition position (16PIP). Blockage of the activation trigger (16) indirectly blocks the piezoelectric actuator (21) from returning to a pre-ignition position (21PIP) because the top housing (21TH) of the actuator abuts the activation trigger (16). This blockage forces the hammer arm (21HA) to stop at the safety position (21SF) instead of proceeding upward to the pre-ignition position (21PIP) under the rebound force of compression spring (B).

Referring to FIGS. 3–6A, the safety switch (50) of the present invention has a slanted member (52) attached to the lighter housing (18). The slanted member having an engagement surface (52E) and a straight surface (52S). The safety switch (50) also has a U-shaped sliding slot member (54) that is moveable along the slanted member (52) from an operational position (54OP) to a safety position (54SF).

The sliding slot member (54) has a blocking shoulder (54B) that contacts the activation trigger (16) when the sliding slot member (54) is in the safety position (54SF). The sliding slot member blocks the activation trigger (16) and prevents it from returning to a pre-ignition position (16PIP) after the activation trigger (16) has been urged to an ignition position (16IP).

Further, the sliding slot member has a resilient pane (54R) and a guide arm (54G) connected to the blocking shoulder (54B). The resilient pane (54R), the guide arm (54G), and the blocking shoulder (54B) provide the sliding slot member (54) with its U-shape.

Referring further to FIGS. 3–6A, the resilient pane (54R) is moveable along the engagement surface (52E) of the slanted member (52) from an operational position (54ROP) to a safety position (54RSF) when the activation trigger (16) is urged from the pre-ignition position (16PIP) to the ignition position (16IP) at which the piezoelectric actuator (21) generates a spark to ignite a flame (100) as illustrated in FIG. 3A.

Referring further to FIGS. 3–6A, the guide arm is moveable between a straight surface (52S) of the slanted member (52) and a straight inner surface (18I) of the lighter housing (18) when the sliding slot member (54) moves between an operational position (54OP) and a safety position (54SF). The sliding slot member (54) has a safety trigger (56) extending from the guide arm (54G) and disposed forward of the activation trigger (16). The safety trigger (56) extends through an opening (62) in the lighter housing (18) such that the safety trigger is accessible to an adult operator.

The safety trigger (56) is moveable along a straight trigger surface (18T) of the housing (18) from a safety trigger off position (56OFF) to a safety trigger on position (56ON). Movement of the safety trigger (56) to the safety off position (56OFF) places the resilient pane (54R) in an operational position (54ROP) along the engagement surface (54E) of the slanted member (54) and places the sliding slot member (54) into an operational position (54OP)

Referring to FIGS. 3A, 4A, 4B, 5, 5A, 6, 6A, the safety switch (50) abuts against a leading edge (16L) of the activation trigger when preventing the activation trigger (16) from returning to a pre-ignition position (16PIP) after urgement of the activation trigger to an ignition position (16IP). In practice, after the operator ignites the lighter (11), the safety trigger (56) automatically resets into a safety on position (56ON). The operator is required to move the safety trigger (56) upwardly into the safety off position (56OFF) to allow the activation trigger (16) to return to a pre-ignition position (16PIP) and in turn to allow the piezoelectric actuator (21) to return to a pre-ignition position (21PIP). The lighter (11) may then be ignited by downward movement of the activation trigger (16).

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A safety lighter having a piezoelectric actuator attached to a lighter housing, said piezoelectric actuator positioned adjacent to an activation trigger, said activation trigger slidably attached to said housing, said safety lighter comprising:

a safety switch slidably attached to said housing and positioned adjacent to said activation trigger, said safety switch having a first slanted member attached to said housing and a sliding slot member positioned adjacent to and movable along said slanted member, said sliding slot member comprising a blocking shoulder capable of engaging said activation trigger to prevent said activation trigger from returning to a first pre-ignition position after urgement of said activation trigger to an ignition trigger position, upon movement of said blocking shoulder in an upward direction, said activation trigger is allowed to return to said pre-ignition position.

2. A safety lighter having a piezoelectric actuator attached to a lighter housing, said piezoelectric actuator positioned adjacent to an activation trigger, said activation trigger slidably attached to said housing, said safety lighter comprising:

a safety switch slidably attached to said housing and positioned adjacent to said activation trigger, said safety switch having a first slanted member attached to said housing and a sliding slot member positioned adjacent to and movable along said slanted member, said sliding slot member comprising a blocking shoulder capable of engaging said activation trigger to prevent said activation trigger from returning to a first pre-ignition position after urgement of said activation trigger to an ignition trigger position, said sliding slot member movable along said slanted member from a first operational position to a second safety position, while positioned in said second safety position said blocking shoulder of said sliding slot member is capable of blocking said activation trigger from returning to said first pre-ignition position after urgement of said activation trigger to said ignition trigger position, upon movement of said blocking shoulder in an upward direction, said activation trigger is allowed to return to said pre-ignition position.

3. The lighter of claim 2 wherein said sliding slot member is generally un-shaped and further comprises a resilient pane and a guide arm which are connected to said blocking shoulder to form said u-shape sliding slot member.

4. The lighter of claim 3 wherein said resilient pane is moveable from a first pane operational position along an engagement surface of said slanted member to a second pane safety position when said activation trigger is urged from said pre-ignition trigger position to said ignition trigger position whereby said piezoelectric actuator generates an ignition spark to ignite a flame.

5. The lighter of claim 3 wherein said sliding slot further comprises a safety trigger member extending from said guide arm and disposed forward of said activation trigger.

6. The lighter of claim 5 wherein said safety trigger is moveable along a straight trigger surface of said housing from a first safety trigger off position to a second safety trigger on position, said first safety trigger off position positioning said resilient pane at said pane first operational position along said engagement surface of said slanted member whereby said activation trigger is in said pre-ignition trigger position, said second safety trigger on position positioning said resilient pane at said pane second safety position whereby said blocking shoulder blocks said activation trigger from returning to said pre-ignition position after urgement of said activation trigger to said ignition trigger position.

7. The lighter of claim 3 wherein said guide arm is moveable between a straight surface of said slanted member and a straight inner surface of said housing when said sliding slot member moves from said first operational position to said second safety position.

8. The lighter of claim 2 wherein said activation trigger further comprises a leading edge portion positioned adjacent to said safety switch, said blocking shoulder of said safety switch capable of abutting against said leading edge of said activation trigger when preventing said activation trigger from returning to said first pre-ignition position after urgement of said activation trigger to said ignition trigger position.

9. A safety lighter having a piezoelectric actuator attached to a lighter housing, said piezoelectric actuator positioned adjacent to an activation trigger, said activation trigger slidably attached to said housing, said safety lighter comprising:

a safety switch slidably attached to said housing and positioned adjacent to said activation trigger, said safety switch having a first slanted member attached to said housing and a sliding slot member positioned adjacent to and movable along said slanted member, said sliding slot member comprising a blocking shoulder capable of engaging said activation trigger to prevent said activation trigger from returning to a first pre-ignition position after urgement of said activation trigger to an ignition trigger position;

said sliding slot member movable along said slanted member from a first operational position to a second safety position, while positioned in said second safety position, said blocking shoulder of said sliding slot member is capable of blocking said activation trigger from returning to said first pre-ignition position after urgement of said activation trigger to said ignition trigger position, upon movement of said blocking shoulder in an upward direction, said activation trigger is allowed to return to said pre-ignition position.

10. The lighter of claim 9 wherein said sliding slot member further comprises a resilient pane and a guide arm, said resilient pane and said guide arm attached to said blocking shoulder such that said sliding slot member is generally u-shaped.

11. The lighter of claim 10 wherein said slanted member further comprises an engagement surface, said resilient pane of said sliding slot member capable of movement along said engagement surface from a first pane operational position to a second pane safety position upon urgement of said activation trigger from said pre-ignition trigger position to said ignition trigger position whereby said piezoelectric actuator generates an ignition spark to ignite a flame.

12. The lighter of claim 10 wherein said sliding slot member further comprises a safety trigger member attached to and extending from said guide arm of said safety switch, said safety trigger disposed forward of said activation trigger with respect to said housing.

13. The lighter of claim 12 wherein said housing further comprises a straight trigger surface, said safety trigger movable along said straight trigger surface from a first safety trigger off position to a second safety trigger on position, said first safety trigger off position positioning said resilient pane of said sliding slot member at said pane first operational position such that said resilient pane engages said engagement surface of said slanted member whereby said activation trigger is positioned in said pre-ignition trigger position, said second safety trigger on position positioning said resilient pane of said sliding slot member at said pane second safety position whereby said blocking shoulder of said sliding slot member blocks said activation trigger from returning to said pre-ignition position after urgement of said activation trigger to said ignition trigger position.

14. The lighter of claim 10 wherein said housing further comprises a straight inner surface and said slanted member further comprises a straight surface, said guide arm of said sliding slot movable between said straight surface and said straight inner surface when said sliding slot member is urged from said first operational position to said second safety position.

* * * * *